US008888233B2

(12) United States Patent
Muhl et al.

(10) Patent No.: US 8,888,233 B2
(45) Date of Patent: Nov. 18, 2014

(54) DEVICE FOR CLEANING WIPER ELEMENTS FOR AN INKJET PRINT HEAD

(75) Inventors: Wolfgang Muhl, Hohen Neuendorf (DE); Axel Ortmann, Berlin (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 859 days.

(21) Appl. No.: 12/423,116

(22) Filed: Apr. 14, 2009

(65) Prior Publication Data

US 2009/0303284 A1 Dec. 10, 2009

(30) Foreign Application Priority Data

Jun. 6, 2008 (DE) ..... 20 2008 007 604 U

(51) Int. Cl.
*B41J 2/165* (2006.01)
*G07B 17/00* (2006.01)

(52) U.S. Cl.
CPC ... *B41J 2/16535* (2013.01); *G07B 2017/00532* (2013.01); *G07B 2017/00556* (2013.01); *B41J 2/16588* (2013.01); *B41J 2/16541* (2013.01)
USPC ..... 347/31

(58) Field of Classification Search
None
See application file for complete search history.

(56) References Cited

U.S. PATENT DOCUMENTS

| | | | | |
|---|---|---|---|---|
| 6,183,059 | B1 | 2/2001 | Muhl et al. | |
| 6,805,427 | B2 * | 10/2004 | Hosono | 347/31 |
| 7,341,329 | B2 * | 3/2008 | Takagi | 347/33 |
| 2003/0081052 | A1 * | 5/2003 | Urrutia et al. | 347/31 |
| 2005/0007412 | A1 | 1/2005 | Nishikawa et al. | |
| 2007/0097173 | A1 | 5/2007 | Hubler et al. | |
| 2007/0171254 | A1 * | 7/2007 | Matsuoka et al. | 347/31 |

FOREIGN PATENT DOCUMENTS

EP 1 518 689 A1 3/2005

* cited by examiner

*Primary Examiner* — Alejandro Valencia
(74) *Attorney, Agent, or Firm* — Schiff Hardin LLP

(57) ABSTRACT

In a device to clean wiper elements of an inkjet print head of an ink dispenser of a printing apparatus having a chassis, a maintenance station is mounted on the chassis to allow travel of the maintenance station in at least one direction that causes the maintenance station to move past the inkjet print head. The maintenance station carries wiper elements that wipe ink from the surface of the inkjet print head as the maintenance station moves past the inkjet print head. An ink uptake unit is mounted at the chassis at a position past which the maintenance station travels, after traveling past the inkjet print head. The ink uptake unit includes material that transfers ink from the wipers to the material.

6 Claims, 5 Drawing Sheets

DEVICE FOR CLEANING WIPER ELEMENTS FOR AN INKJET PRINT HEAD

BACKGROUND OF THE INVENTION

1. Field of the Invention

The present invention concerns a device for cleaning wiper elements for an inkjet print head of an ink dispenser. The invention is suitable for an inkjet printing device that is used for mail processing, addressing and franking machines, and other inkjet printing apparatuses.

2. Description of the Prior Art

The use of a sponge element in a franking machine of the Jetmail® type is described in European patent application EP 885 726 A1. This sponge element is attached to the print head and serves to wipe off the wiper lips that are arranged on the carriage of a cleaning and sealing station (RDS). The solution is expensive because more ink that must be wiped off and absorbed by the sponge also collects on the much larger (in comparison to HP print heads) print head surface of the special print head of the Jetmail®. Since, due to the large amount of ink, the absorption capacity of the sponge is soon exceeded, time-consuming and costly measures for suctioning the excess ink from the sponge element are required for maintenance.

For example, modern franking machines with inkjet technology use print heads from Hewlett Packard that have wiper elements in order to remove the excess ink from the print head. Either the print head travels over a stationary wiper element or the wiper element travels over the stationary head. The excess ink taken up by the wiper elements is stripped off by stripping elements (scrapers, (blades)). Since the HP print heads have a relatively small print head surface, this conventional arrangement is sufficient.

A device to clean an inkjet print head for a franking machine of the Centormail® type is known from European patent application EP 1 782 954 A1. The inkjet print head is a component of each ink cartridge. Two ink cartridges are arranged in a receptacle such that they can be exchanged. The receptacle is pivotable into a printing position so that the inkjet print head is stationary in a printing window of a guide plate for the flat mail pieces (printing media) during the printing. A cleaning and sealing station serves as a maintenance station and is likewise arranged such that it can be displaced below the guide plate and can be moved toward and away from the inkjet print head. A stripper is arranged separate from the print head mounted on a stripper mount, the latter being attached to the chassis. Two strippers serve to wipe off the wiper lips that are arranged on the carriage of a cleaning and sealing station (RDS) when the carriage is moved away from the inkjet print head again and travels back into its initial position.

The postal requirements for digital legibility of a franking imprint must be satisfied with certainty.

It has been empirically established that the strippers previously used in the franking machine of the Centormail® type to clean the wiper lips are often insufficient, such that ink residues dry on the wiper elements. In many cases the dried ink has polluting effects upon a new wiping of the damp heads, which reduce the print quality or possibly could lead to failure of the print head.

SUMMARY OF THE INVENTION

An object of the present invention is to improve the maintenance and to achieve a device for cleaning wiper elements in an inkjet printing apparatus, wherein depositing and drying of excess ink residues on the wiper elements is avoided due to the action of the device. The cleaning of the wiper elements should be enabled independent of the movement of the print head and should be integrated into the maintenance workflow of the printing group without additional cost.

The object is achieved in accordance with the invention by a cleaning device for an inkjet print head having an ink uptake unit that passively takes up ink into the uptake unit itself and that is arranged on the chassis of the printing apparatus at a point past which a maintenance station moves, the maintenance station traveling in at least one direction. The maintenance station has wiper elements that dispense ink to the ink uptake element during the passing movement. The ink uptake unit is advantageously a sponge module formed by a sponge mount, a sponge body and a mounting plate. The sponge body binds the ink by suction due to the capillary effect and thus cost-effectively removes the excess ink after every wiping procedure by the wiper elements (i.e. immediately after the wiping of the print head surface) when the maintenance station is moved, or the carriage of the RDS returns from the wiping to its initial position. It can therefore be ensured that the wiper elements wipe across the print head only when they are in a clean state. The sponge module is mounted stationary in the rear part of the chassis as an independent module, so that the sponge element can itself easily be exchanged when the RDS has traveled into the sealing position in the forward part. Automated suctioning of the ink from the sponge is not necessary, so that a simpler and cost-effective embodiment is achieved relative to the solution according to EP 885 726 A1.

DESCRIPTION OF THE PREFERRED EMBODIMENTS

Figure 1:
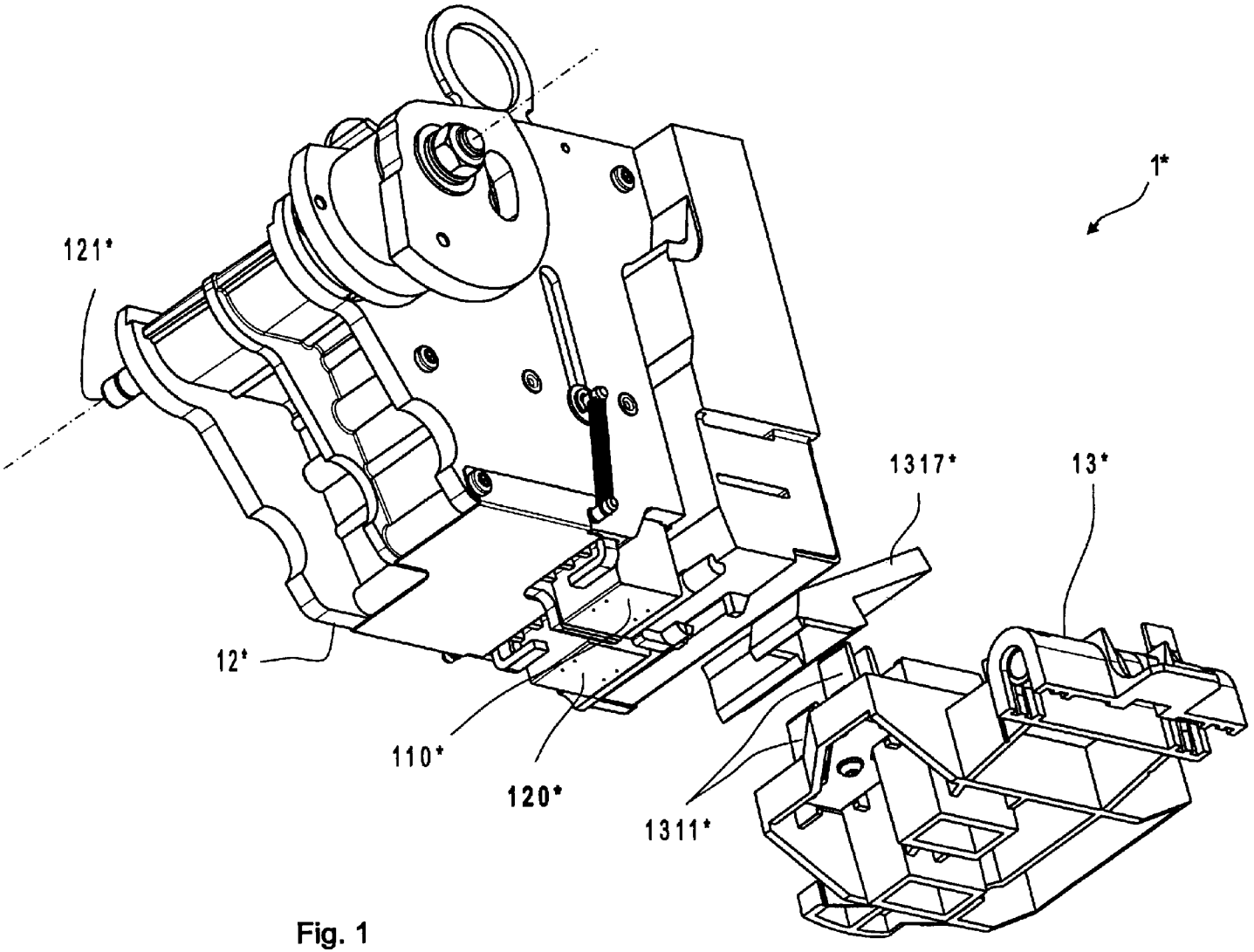
FIG. 1 is a perspective view, from the front lower right, of a known device for cleaning of wiper elements for an inkjet print head of a known franking machine of the Centormail® type, with the RDS in a starting position.

A perspective view of the known device 1* of the franking machine of the Centormail® type is shown in FIG. 1, seen from the front lower right. A print head receptacle 12* carries two inkjet print heads 110*, 120* and is shown pivoted on an axis 121* into a cleaning position. A cleaning and sealing device (RDS) 13* that carries wiper elements 1311* has been moved into a starting position in the rear part of the franking machine. A stripper mount 1317* is arranged between the RDS 13* and the print head receptacle 12*. The stripper mount carries strippers on its downward facing edges, at which strippers the stripped ink initially drips down. However, a residue of ink remains clinging due to adhesion and can then dry.

Figures 2A, 2B:
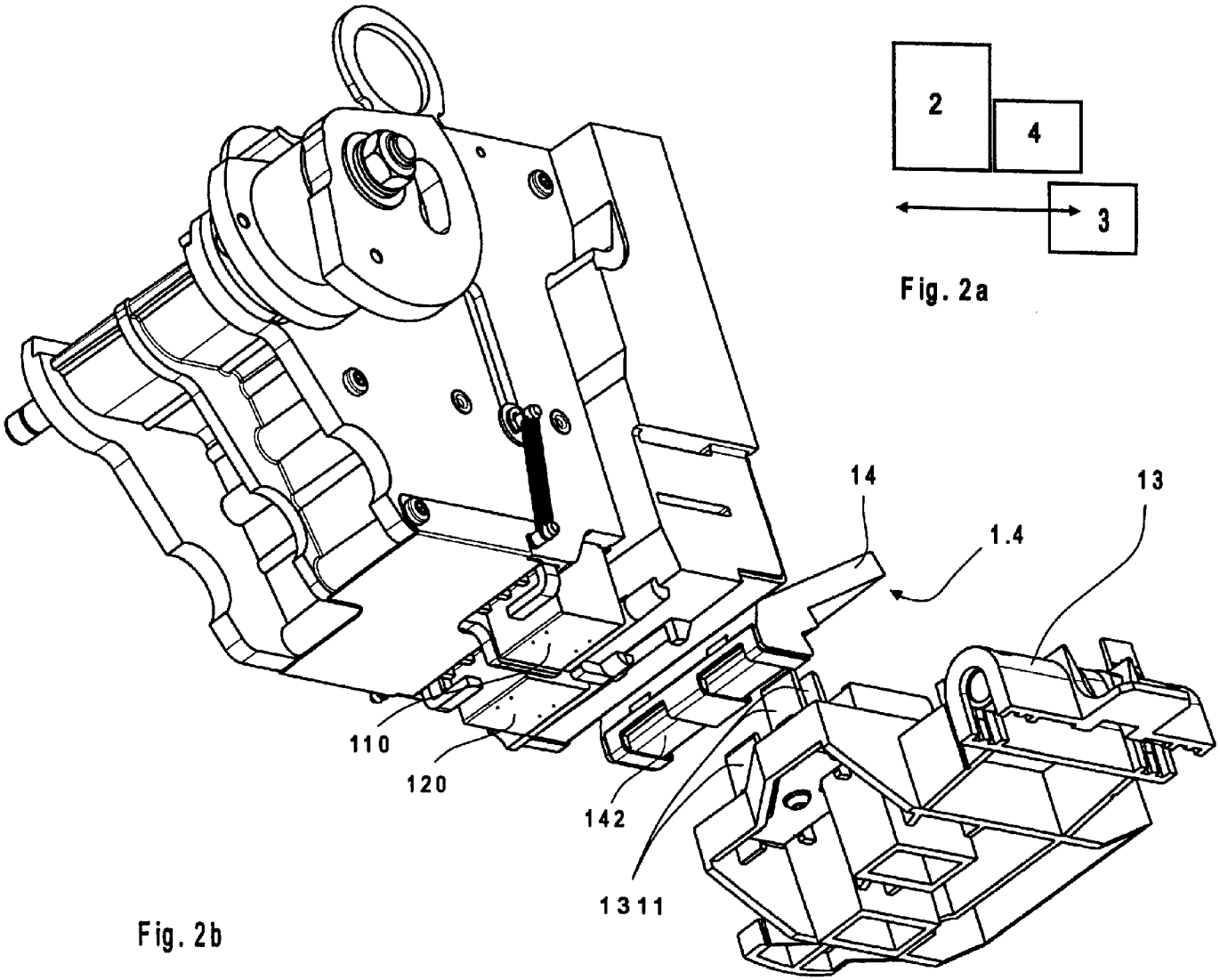
FIG. 2*a* shows the basic configuration of the arrangement of a few modules of an inkjet printing device with the cleaning device according to the invention.
FIG. 2*b* is a perspective view, from the front lower right, of the device in accordance with the invention for cleaning wiper elements for an inkjet print head.

The basic configuration of the arrangement of a few modules of an inkjet printing device in connection with the device according to the invention for cleaning of wiper elements is explained using FIG. 2*a*. An ink dispenser 2 and an ink uptake unit 4 are arranged along a path on which a maintenance station 3 is moved.

A perspective view of the improved device 1 for cleaning of wiper elements for an inkjet print head is shown from the front lower right in FIG. 2*b*. The arrangement of the modules in the printing device of the known franking machine of the Centormail® type relative to one another is in principle the same as was shown in FIG. 1, but instead of a stripper mount an ink uptake unit 4 is used that is arranged between the ink dispenser 2 and the maintenance station 3 at the rear part of the chassis. A print head receptacle can be used as the ink dispenser 2, a cleaning and sealing device 13 can be used as the maintenance station 3, and a sponge module 14 with at least one sponge mount 14 and a sponge body 142 can be used as the ink uptake unit 4.

Figure 3A:
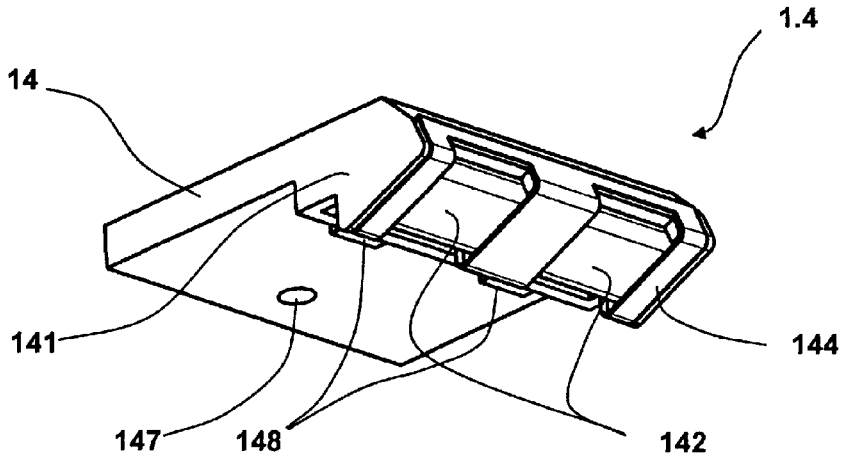
FIG. 3*a* is a perspective view of the sponge module from the front lower left.

FIG. 3*a* shows a perspective view of the sponge module from the front lower left. The sponge module 14 consists of a sponge mount 14, a sponge body 142 and a retention plate 144. The rear part of the sponge mount is fashioned flat on the bottom and possesses two lifters 148 and an opening 147 for attachment. The front part 141 is fashioned box-shaped on the bottom, with a large opening directed downwardly in which the sponge body 142 with the retention plate 144 is attached at the sponge mount 14.

The opening 147 for attachment in the rear part of the sponge mount is centrally arranged. A stopper edge for a fastening plate (not shown) of the chassis is formed by the box 141 or by an additional box at the transition to the flat rear part of the sponge mount.

Figure 3B:
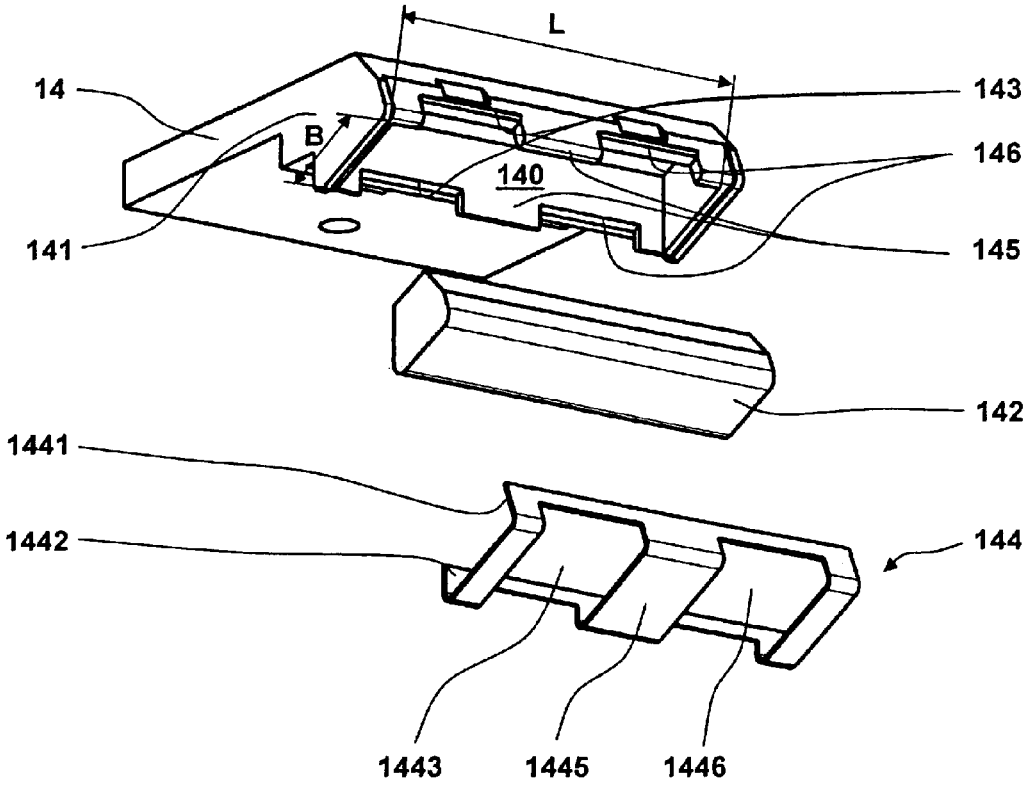
FIG. 3*b* is a perspective view of the sponge module from the front lower left, in an exploded view.

FIG. 3*b* shows a perspective view of the sponge module from the front lower left in an exploded representation. The sponge mount 14 has oblong, approximately rectangular opening 140 in the box 141 whose cross-sectional area tapers inward. The sponge body 142 advantageously has a wedge shape tapering in the direction of the floor of the opening and a rounded, rectangular shape on the surface, matching the opening in the sponge mount. The opening 140 is bordered by four side walls of the box 141, wherein two admissions 143 and 146 are respectively molded in two opposite side walls, which admissions 143 and 146 allow the wiper lips to slide through when the RDS wipes the wiper lips off on the sponge in a maintenance phase. A wall part 145 stands between the admissions 143 and 146 of the side wall and the opposite side wall of the edge 141.

The retention plate 144 is curved in a u-shape, wherein its side surfaces 1441 and 1442 are slightly curved inward and thereby exert an elastic force on the sponge mount 14 in a mounted state. The footprint of the retention plate 144 has the dimensions of the largest cross-sectional area on the surface of the sponge body. The footprint 1445 of the retention plate possesses two rectangular openings 1443, 1446 that extend in the two side surfaces 1441 and 1442, each suitable for a passage of a pair of wiper elements for a respective print head during the wiping-off. The two openings are separated from one another corresponding to the interval of the two print heads in the print head receptacle.

The front part of the sponge mount is flat on top and is fashioned in a box shape on the bottom, with a large opening directed downwardly. The opening has a width B and a length L, with B<L.

The sponge 142 is produced from, for example, a biodegradable, synthetically manufactured material and can also be reused as necessary after washing out the ink. If necessary, it is washed out with an antibacterial solution when a longer time interval has passed and its absorption capacity for ink is depleted.

Figure 4:
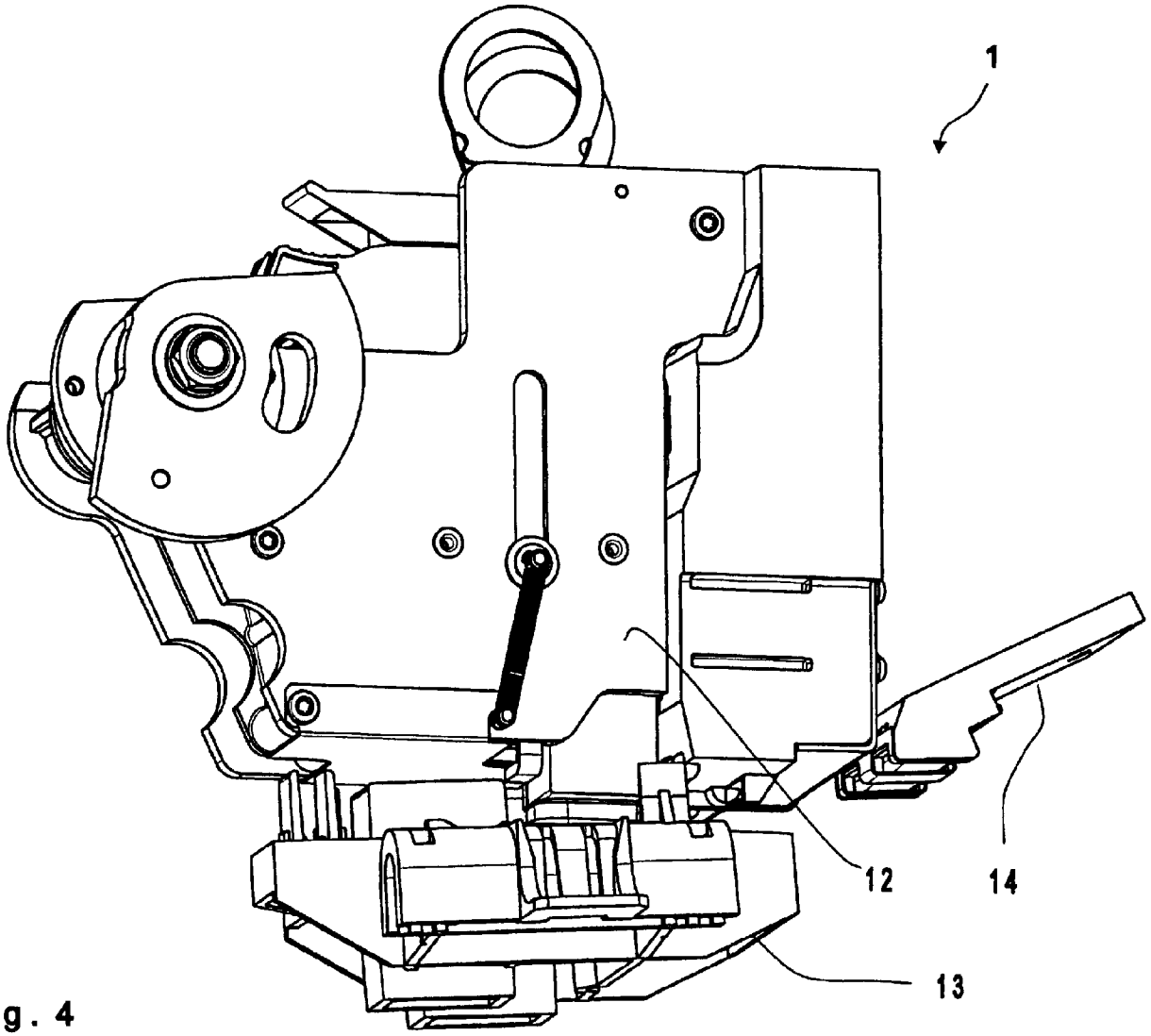
FIG. 4 is a perspective view of the improved device from the front lower right, with the RDS in the sealing position.

A perspective view of the improved device from the front lower right, with the print head receptacle 12 and RDS 13 shown in the sealing position, is shown in FIG. 4. In this position the print heads are protected from drying out. In contrast to this, the ink may dry on the sponge of the sponge mount 14.

Figure 5:
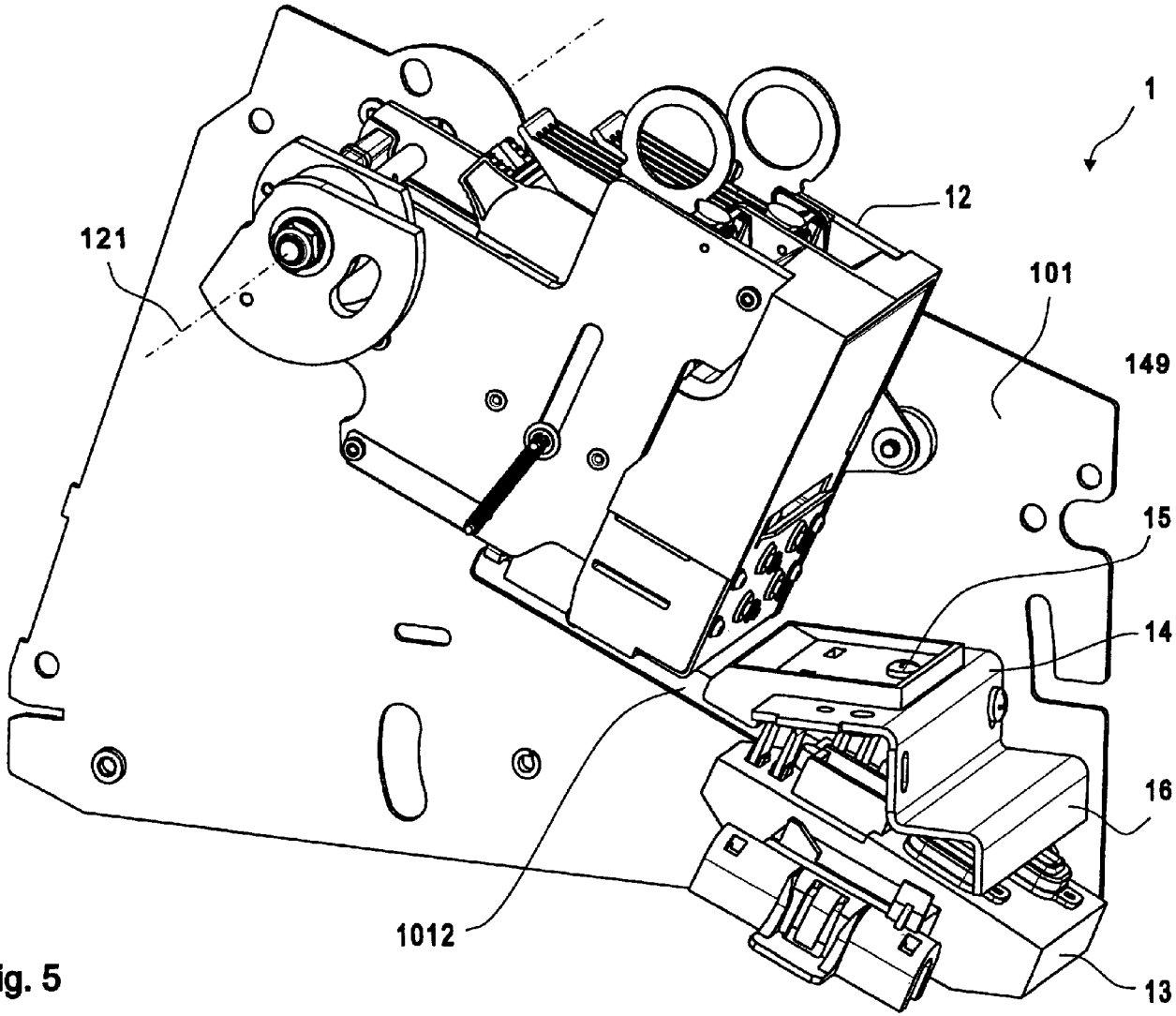
FIG. 5 is a perspective view of the device in accordance with the invention from the rear upper right, with the RDS in the starting position.

In FIG. 5 is a perspective view of the improved device from the rear upper right, with RDS 13 in the starting position. The print head receptacle 12 is arranged between two side walls of a frame of the inkjet printing device such that said receptacle 12 can pivot; the left side wall 101 of the inkjet printing device is shown in the background. In the drawn starting position the RDS 13 is located in the lower rear part of the frame whose left side wall possesses an introduced guide in the form of a diagonal oblong hole 1012 running forward and upward in which the carriage of the RDS 13 is directed, i.e. slides along when the RDS 13 is moved into the sealing position.

The print head receptacle 12 has a rotation axis 121 in the front upper part of the frame. An ink update means (advantageously a sponge module with a sponge mount 14) is arranged between the RDS 13 and the print head receptacle 12 in the rear part of the frame and is attached to the plate part 16 of the chassis of the printing device of the franking machine by means of a bolt 15 in the shown manner. The sponge mount 14 has a box-shaped cavity 149 in the upper part.

The ink uptake unit 4 is economically formed as a synthetically produced sponge, but suitable naturally occurring substances can be used as well.

The shape of the ink uptake means must naturally be adapted to the number and shape of the wiper elements (wiper lips) so that it is suitable to wipe off said wiper elements. The number of wiper elements in the aforementioned exemplary embodiment is only two per print head.

As an alternative to the present embodiment, an equivalent ink uptake unit can naturally also be used which is based on a different material with similar properties.

For example, absorbent fleece is suitable that has a hygroscopic effect or that interacts with a suitable hygroscopic substance or material, or is coated or impregnated with a suitable chemical element or a chemical compound. The ink uptake unit 4 can also have a special absorbent foam substance. The foam substance/sponge/fleece can be round or angular or can be tailored to an arbitrary suitable shape. The ink uptake means should not exclude any passively active means or substance or, respectively, chemical element or a chemical compound; only active means should be excluded.

The ink uptake unit 4 can be realized in an arbitrary form and is arranged on the chassis of the inkjet printing device at a point past which a maintenance station 3 or the RDS 13 is moved in at least one direction.

The ink dispenser 2 does not have to be as in the shown embodiment, but can also be designed alternatively, i.e. differently than is shown, or in modified form.

Although modifications and changes may be suggested by those skilled in the art, it is the intention of the inventors to embody within the patent warranted hereon all changes and modifications as reasonably and properly come within the scope of their contribution to the art.

We claim as our invention:

1. A device to clean wiper elements for an inkjet print head of an ink dispenser of a printing apparatus having a chassis, said device comprising:

a maintenance station configured to be mounted on said chassis to allow travel of said maintenance station in at least one direction that causes said maintenance station to move past said inkjet print head;

said maintenance station carrying wiper elements that interact with a surface of said inkjet print head to wipe ink from said surface as said maintenance station moves past said inkjet print head;

an ink uptake unit comprising a sponge body mount configured to be removably attached to said chassis at a stationary position on the chassis traveled past by said maintenance station after said maintenance station travels past said inkjet print head, and a stationary sponge body fixedly held in said sponge body mount, said stationary position of said sponge body mount causing said sponge body to rub against said wiper elements as said maintenance station passes by said ink uptake unit, and said sponge body being comprised of material that interacts with said wipers to transfer the ink from said wipers to said material that said wipers wiped from said surface of said inkjet print head, and said material of said sponge body binding said ink in said sponge body by suction due to capillary action;

said sponge body mount comprising an attachment portion and a receptacle portion adjacent to said attachment portion, said attachment portion and said receptacle portion, in combination, forming a flat surface of said sponge body mount that is configured to abut against said chassis, said receptacle portion comprising at least one open box that receives said sponge body therein with a surface of said sponge body in said open box facing away from said flat surface; and said attachment portion of said sponge body mount having a single central opening therein configured to receive a single attachment element that exclusively attaches said sponge body mount to said chassis by engagement of said single attachment element with said chassis, said single attachment element allowing removal of said sponge body mount with said sponge body therein from said chassis to clean said sponge body of said ink bound therein, solely by disengaging said single attachment element from said chassis.

2. A device as claimed in claim 1 wherein said maintenance station is movable to a rear of said chassis, and wherein said ink uptake unit is located between said inkjet print head and said maintenance station, when said maintenance station is located at said rear of said chassis.

3. A device as claimed in claim 1 wherein said material of said sponge is a biodegradable, synthetic material.

4. A device as claimed in claim 1 wherein said open box, has an inwardly tapering cross-sectional area that holds said sponge body in said opening.

5. A device as claimed in claim 1 wherein said sponge body has a wedge-shape that tapers in a direction of a base of said opening and is rectangularly rounded on a surface, conforming to said opening in said sponge mount.

6. A device as claimed in claim 1 wherein said maintenance station is configured for wiping an inkjet print head selected from the group consisting of mail processing inkjet print heads, addressing inkjet print heads, and franking machine inkjet print heads.

* * * * *